United States Patent [19]

Rosegren et al.

[11] 4,411,744

[45] Oct. 25, 1983

[54] BATH AND PROCESS FOR HIGH SPEED NICKEL ELECTROPLATING

[75] Inventors: Donald R. Rosegren, Cresskill; Linda J. Mayer, Denville, both of N.J.

[73] Assignee: Occidental Chemical Corporation, Warren, Mich.

[21] Appl. No.: 407,662

[22] Filed: Aug. 16, 1982

Related U.S. Application Data

[63] Continuation-in-part of Ser. No. 199,894, Oct. 23, 1980, abandoned.

[51] Int. Cl.[3] ..... C25D 3/12

[52] U.S. Cl. ..... 204/49

[58] Field of Search ..... 204/49, 43 T, 112, 123

[56] References Cited

U.S. PATENT DOCUMENTS 2,842,487 7/1958 Carr ..... 204/49

*Primary Examiner*—G. L. Kaplan

*Attorney, Agent, or Firm*—Richard P. Mueller

[57] ABSTRACT

Electroplating baths for producing semi-bright, ductile, low stressed nickel deposits in an electrodeposition process utilizing insoluble anodes are disclosed. The nickel baths contain, in addition to nickel salts, ortho-formyl benzene sulfonic acid and perfluorocyclohexyl potassium sulfonate.

5 Claims, No Drawings

BATH AND PROCESS FOR HIGH SPEED NICKEL ELECTROPLATING

This application is a continuation-in-part of application Ser. No. 199,894, filed Oct. 23, 1980 and now abandoned.

BACKGROUND OF THE INVENTION

It is well known in the art pertaining to electrolytic nickel systems to utilize soluble anodes. The use of soluble anodes was prescribed because the prior belief was that organic additives in the bath would break down in the presence of insoluble anodes. Furthermore, it is known that the stress of the nickel deposit is adversely affected by the insoluble anodes. For various commercial reasons it would be highly desirable to use insoluble anodes in a nickel electroplating system without encountering additive break down or stressed nickel deposits.

Typical U.S. patents relating to nickel plating include U.S. Pat. Nos. 2,228,991 (Freed); 2,409,119 (Freed); 2,409,120 (Freed et al.); 2,485,149 (Freed et al.); and 2,998,360 (Castellano). As far as can be determined, these patents involve the use of a conventional or modified consumable anode. See, for example, page 2, column 2, lines 53 to 64, of U.S. Pat. No. 2,228,991.

SUMMARY OF THE INVENTION

The present invention relates to a new and improved electroplating bath for use with insoluble anodes and can be operated at relatively high speeds to produce nickel deposits which are also relatively stress-free. The insoluble anodes which can be employed in the process of this invention are, for example, platinized titanium, platinized tantalum, platinized columbium (niobium) as well as a platinum metal anode itself. Additionally, titanium anodes having mixed oxide coatings, such as ruthenium dioxide - titanium dioxide coatings, may also be used.

The electroplating bath of this invention contains certain prescribed additives which do not break down during operations carried out in the presence of insoluble anodes. In addition to a conventional nickel source, e.g. nickel sulfate, and a conducting agent such as boric acid, the electroplating bath will contain ortho-formyl benzene sulfonic acid as the brightener and perfluorocyclohexyl potassium sulfonate, as the wetting agent.

DETAILED DESCRIPTION OF THE INVENTION

In general, the electroplating baths of the present invention will be formulated as follows:

| Component | Concentration g/l |
|---|---|
| Nickel Salt | 30 to 105 (as Ni) |
| Electrolyte | 20 to 100 |
| O-formyl benzene sulfonic acid | 0.25 to 3.0 |
| Perfluorocyclohexyl potassium sulfonate | 0.02 to 0.2 |

The preferred sources of the nickel metal are nickel sulfate, nickel citrate, nickel carbonate, and the like. These salts are preferably employed in an amount of from about 135 to 470 grams per liter to provide the desired nickel metal concentration.

Electrolytes which are most useful for the present purpose are boric acid, citric acid, and the like. The preferred amounts used in preparing the electroplating baths of this invention will range from about 22.5 to 45 grams per liter. The use of boric acid is especially preferred.

The organic components of the bath are usually the brighteners and the wetting agents. In formulating the special electroplating bath of this invention the specific brightener employed is ortho-formyl benzene sulfonic acid. The required wetting agent is perfluorocyclohexyl potassium sulfonate, which has the formula:

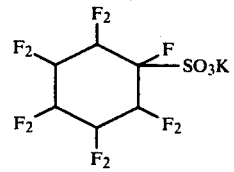

For most purposes the pH of the electroplating bath is adjusted to a range of about 2 to 5, preferably 2.5 to 4.5. The compounds used to effect the pH adjustment include nickel carbonate, sulfuric acid, potassium citrate, or citric acid.

The baths of the present invention are operated at temperatures of about 46 to 57 degrees C. and at a relatively high current density of up to about 1000 ASF, and preferably about 100 to 600 ASF. The ability to use such high current densities is another important advantage of the electroplating baths of the present invention.

Nickel deposited on various substrates when utilizing the baths of this invention are characterized by being semi-bright, ductile, and low-stressed. Heretofore the obtention of such properties required consumable anodes in nickel electroplating systems.

The invention will be more fully understood by reference to the following illustrative embodiment.

EXAMPLE

An electroplating bath was formulated from the following ingredients:

| Components | Concentration g/l |
|---|---|
| Nickel Sulfate | 75 (as Ni) |
| Boric Acid | 40 |
| O-formyl benzene sulfonic acid | 1.5 |
| Perfluorocyclohexyl potassium sulfonate | 0.1 |

Prior to use, sufficient nickel carbonate was added to the bath to adjust the pH to about 2.5. The bath was used in a conventional electroplating bath with platinized titanium anodes to coat copper at 55° C. and 500 ASF. The resulting nickel deposit was semi-bright and ductile. Further analysis indicated low-stress. In utilizing this bath, substantially no break down of the organic additives present in the bath was noted.

It will be understood that the illustrative embodiment set forth above is subject to variations and modifications without departing from the broader aspects of the present invention.

What is claimed is:

1. An electroplating bath suitable for use with insoluble anodes in the electrodeposition of semi-bright, ductile and stress-free nickel deposits, said bath comprising a nickel salt; an electrolyte selected from the group consisting of boric acid and citric acid; ortho-formyl benzene sulfonic acid as a brightener; and a wetting agent comprising perfluorocyclohexyl potassium sulfonate.

2. The electroplating bath of claim 1 wherein the nickel salt is nickel sulfate.

3. The electroplating bath of claim 1 wherein the electrolyte is boric acid.

4. The electroplating bath of claim 1 having a pH of 2.5 to 4.5.

5. A method for electrodepositing nickel on a substrate which comprises passing an electric current between a cathode and an insoluble anode through an electroplating bath as defined in claim 1, 2, 3 or 4 for a period of time sufficient to deposit the desired thickness of nickel.

* * * * *